United States Patent [19]

Sims

[11] 4,354,421

[45] Oct. 19, 1982

[54] ENERGY RECOVERY RECIPROCATING ENGINE

[75] Inventor: J. Robert Sims, Baton Rouge, La.

[73] Assignee: Exxon Research & Engineering Co., Florham Park, N.J.

[21] Appl. No.: 170,250

[22] Filed: Jul. 18, 1980

[51] Int. Cl.[3] ..... F15B 21/02; F01L 15/12; F01L 15/16

[52] U.S. Cl. ..... 91/39; 91/183; 91/224; 91/268; 91/273; 91/401; 91/410

[58] Field of Search ..... 91/39, 40, 224, 229, 91/401, 410, 325, 187, 268, 273, 183

[56] References Cited

U.S. PATENT DOCUMENTS

| | | | |
|---|---|---|---|
| 1,045,630 | 11/1912 | Stumpf | 91/325 |
| 1,045,956 | 12/1912 | Demmler | 91/401 |
| 3,397,619 | 8/1968 | Sturtevant | 91/325 |
| 3,587,394 | 6/1971 | Hilbrands | 91/39 |
| 4,168,655 | 9/1979 | Kitrilakis et al. | 91/325 |

*Primary Examiner*—Paul E. Maslousky
*Attorney, Agent, or Firm*—M. B. Kurtzman

[57] ABSTRACT

An improvement in a reciprocating engine used in an energy recovery system wherein the inlet valves to the cylinders of the engine are operated by independently time adjustable actuating means.

The system for recovering energy from a pressured reactor comprising a reactor, a reciprocating engine connected to the reactor to receive reaction effluent from said reactor thereby driving the pistons of the reciprocating engine by expansion of the effluent and recovery apparatus downstream of the engine for recovering products from the effluent.

The expanding reactor effluent is used to drive the pistons which are especially valved in conjunction with the effluent inlet port in the cylinder to facilitate handling the effluents to adjust the flow into an expansion chamber to obtain maximum recovery, the pistons in turn operate a crankshaft through a crosshead which may power compressors or operate a generator to produce electricity. It is reasonable to expect recovery in a directly usable form, such as electricity, of over 60% of the energy theoretically available in the pressured reactor effluent in some cases.

11 Claims, 7 Drawing Figures

FEED

ENERGY RECOVERY RECIPROCATING ENGINE

BACKGROUND OF THE INVENTION

1. Field of the Invention

The present invention relates to the apparatus for recovering energy during the pressure let-down of high pressure reactor effluent, particularly to a reciprocating engine used for that purpose.

Prior Art

Many chemical reactions are conducted under conditions of high pressure. At some point in the process, this pressure is relieved or dissipated so that the product, unreacted components, etc., can be recovered. Not infrequently, considerable energy has been put into pressurizing the system and reactants. The conventional manner of operating such systems has been merely to lose the energy represented by the effluent pressure by reducing the pressure across a valve.

Most of the prior effort to recover this "process energy" has been concentrated on the design of a turbine through which the reaction effluents would be passed, as shown, for example, in U.S. Pat. Nos. 2,850,361 and 3,649,208. Such an approach may work in a single phase reaction system, however, in a multiphase system, particularly those wherein the pressure reduction is employed to cause phase separation, a turbine is generally unsatisfactory. Many difficulties exist in the design of such a turbine, because as the pressure is reduced, a liquid or solid phase separates from the gas and tends to coat turbine blades and plug passages. Turbine construction is such that imbalancing of the blades by random deposition of material thereon can cause failure of the engine.

U.S. patent application Ser. No. 070,566 filed Aug. 29, 1979 and now U.S. Pat. No. 4,288,406 issued Sept. 8, 1981, commonly owned herewith, which is incorporated herein, discloses a novel system and process employing a novel reciprocating engine for the recovery of energy from pressured reaction effluent. A reciprocating engine is generally a less delicate device than a turbine and is not incapacitated by some degree of fouling. The reciprocating engine which is used to recover the energy in the form of pressure from the reaction system is comprised of two or more cylinders, each having a piston or plunger slidably mounted therein and connected to a crankshaft either directly or indirectly.

Briefly, the reciprocating engine comprises at least one cylinder, said cylinder having an inlet and outlet port, said outlet being distal to said inlet port, means for opening and closing said inlet port, a piston movably mounted in the cylinder, having a conduit therethrough, means for opening and closing said conduit and a drive rod operably associating the said piston(s) to a crankshaft. Each piston is fitted with a valve which is biased open, thereby providing egress therethrough to the outlet in the cylinder. Opposed to each of the valves in each piston seated in the inlet is an inlet valve, which is biased toward the piston and which closes the cylinder. The cylinder is connected to the reactor through the inlet valve. As the piston makes its upward stroke toward the inlet valve in the cylinder, a portion of the piston valve contacts a portion of the inlet valve. The piston valve is forced closed and the inlet valve is then forced open. Effluent fluids then enter the cylinder in an expansion chamber forcing the piston downward, i.e., away from the inlet valve, and disengaging the contact of the two valves which allows the inlet valve to close.

The piston valve opens when the pressure in the expansion chamber between the piston and the inlet valve is equal to the pressure adjacent to the outlets, thereby allowing the fluid to exit the expansion chamber as the piston repeats the cycle.

Each of the pistons is sequenced to provide the conventional reciprocating action.

In particular, the present system and the process and apparatus, are suited for the separation of multiphase effluent systems, wherein the pressure reduction is a means for separation of the phases, for example, the high pressure reaction of ethylene to produce low density polyethylene wherein a substantial portion of the ethylene is unreacted and is separated by depressuring the system whereby the polymer separates as a liquid phase and the unreacted ethylene gas is recycled to the compressors. In a typical reactor, the pressure may be reduced from about 2800 $kg/cm_2$ to about 300 $kg/cm_2$.

It is a particular feature that the present invention provides a substantial increase in energy recovery of the reciprocating engine.

SUMMARY OF THE INVENTION

The improvement in the reciprocating energy recovery engine which results in improved efficiency is a time adjustable actuation of the closure of the inlet valve.

Briefly, the improved reciprocating engine is comprised of at least one cylinder, said cylinder having an inlet and outlet port, said outlet being distal to said inlet port, a first valve movably seated in said cylinder in each of said inlet port(s), means for biasing said first valve into said inlet port, a piston slidably movable in each cylinder, said piston having a conduit therethrough and a second valve, movably mounted in said conduit, opposed to said first valve and aligned to contact said first valve, each of said second valves being biased out of said conduits, whereby contact of said first valve and said second valve in said cylinder forces said second valve into said conduit and forces said first valve out of said inlet port, wherein the improvement comprises a time adjustable means for biasing said first valve into said inlet port to close said inlet. In a preferred embodiment, said engine will have at least two cylinders as described.

The timed means for biasing the first valve closed in the inlet port may be located within the cylinder adjacent to the valve or externally of the cylinder, the improvement being that the actuation of closure of the valve is obtained by timing the means, e.g., by operation of hydraulic piston to force the valve closed or by a mechanical cam. The timing, i.e., adjustment of operation of the closure of the inlet valve allows the closing of the inlet to be varied to achieve the correct outlet pressure at the end of the expansion stroke of the piston for varying inlet pressures and temperatures, whereas the prior means of closure was a constantly biasing means such as a expansion spring which did not allow for timing adjustment.

The cam or hydraulic piston are independently adjustable during the operation of the cylinders (engine) by increasing or decreasing the timing. Each of the pistons in the engine is sequenced to provide for conventional reciprocating action. Inlet valve closing is independent of that sequencing, since the closing of the inlet valve is intended to maximize the isentropic energy recovery from a given volume of reactor effluent.

The prior system recovered only the internal energy contained in the expanding fluid, by admitting a large quantity of fluid into a cylinder with a high clearance volume, (on the order of twice the cylinder displacement) then expanding that fluid isentropically. The hydraulic or flow energy contained in the fluid was lost.

The time adjustable inlet valve closure, described in the present invention, allows the use of a cylinder with a very small clearance volume, thus allowing work to be done on the piston during the time that fluid is being admitted to the cylinder. This system allows recovery of the hydraulic or flow energy contained in the fluid in addition to the internal energy which is recovered after the inlet valve closes and the fluid is allowed to expand.

In addition, this feature allows some control of engine capacity, since the inlet valve can be closed sooner than the optimum point in the cycle, thus admitting less effluent to the cylinder during each cycle and reducing the capacity.

This capacity control is desirable, because it allows the engine to be designed to recover the maximum amount of energy available in the fluid stream. The engine described in the earlier application had a fixed capacity, and therefore had to be designed for the minimum expected effluent flowrate, with a bypass valve around the engine to control pressure in the reactor at effluent flowrates higher than the minimum. The capacity control feature of the present invention allows the engine to be designed for the maximum expected effluent flow rate. The bypass valve is still maintained for start-up and quick reaction to rapid pressure changes in the reactor.

The time adjustable valve closure of the present invention increases the theoretical isentropic efficiency in the thermodynamic cycle to about 95% compared to only a 35 to 40% theoretical efficiency of a time non-adjustable valve closure.

As originally disclosed in the earlier application, a recovery engine with 4 cylinders, each having a diameter of 92 mm and a stroke length of 433.5 mm is used. The engine operates at a speed of 180 revolutions per minute. The clearance volume or the volume enclosed by the cylinder and piston at the moment when the inlet valve closes, is twice the displacement of the piston.

For example, the theoretical energy available from the isentropic expansion of 1 kg of pure ethylene from a pressure of 2,800 kg/cm$^2$ and a temperature of 248° C. to a pressure of 300 kg/cm$^2$ is about 134 kcal. The outlet temperature of the gas would be about 118° C. Typically the reactor effluent consists of approximately 70% unreacted ethylene and 30% polyethylene. The theoretical energy available from the isentropic expansion of this mixture is about 80% of that of pure ethylene, or about 107 kcal per kg of effluent.

Furthermore, part of the reactor effluent will be bypassed around the energy recovery engine for reactor pressure control and bump cycle, which for this example is a 20% by-pass of reactor throughput.

The pressure drop from the engine discharge to the high pressure separator will be a practical limitation in the system for the engine $\Delta P$. For this illustration, a minimum engine discharge pressure of 470 kg/cm$^2$ has been assumed.

The mechanical efficiency of the engine is 80% and the efficiency of the generator which it drives is 95%. Using a correction factor of 80% for the presence of polymer, 80% mechanical efficiency and 95% electrical efficiency, the net power output of the engine is about 27 kcal/kg of reactor effluent or about 25% of the theoretical energy available in the gas polymer mixture. The theoretical isentropic efficiency of the cycle is about 37%. The flow rate of reactor effluent through this engine is about 43,000 kg/hr. The total flow rate in the reactor is about 52,000 kg/hr. The engine produces about 2,300 kw of power, which represents about 25% of the 8,800 kw power input to the recirculating gas compressor used in this process.

An engine with the same size and number of cylinders as the engine originally disclosed in the earlier application, but modified with the inlet valve as described, can be designed to operate at 200 RPM, with a flowrate of reactor effluent of 49,000 kg/hr. which is closer to the total flowrate in the reactor of 52,000 lbs/hr. If the inlet valve of each cylinder is closed after the crankshaft has rotated 95° from the top dead center position of that cylinder, the theoretical power production is 111 kcal/kg. Using the same correction factors as the earlier example (80% for the presence of polymer, 80% mechanical efficiency, 95% electrical efficiency), the net power output is about 67 kcal/kg or about 63% of the theoretical energy available in the gas polymer mixture. The theoretical isentropic efficiency of the cycle is about 94%. The engine produces about 3,800 KW of power, which represents about 43% of the 8,800 KW power input to the recirculating gas compressor used in this process.

Operating the present invention will generally require a reactor effluent having a pressure of about 1500 kg/cm$^2$ up to about 4000 kg/cm$^2$ and more preferably from about 2000 to 3000 kg/cm$^2$.

In the specific example of polyethylene manufacture, the effluent pressure may vary according to the different grades of polyethylene being produced.

DETAILED DESCRIPTION OF THE INVENTION AND PREFERRED EMBODIMENTS

Figures 1, 2, 7:
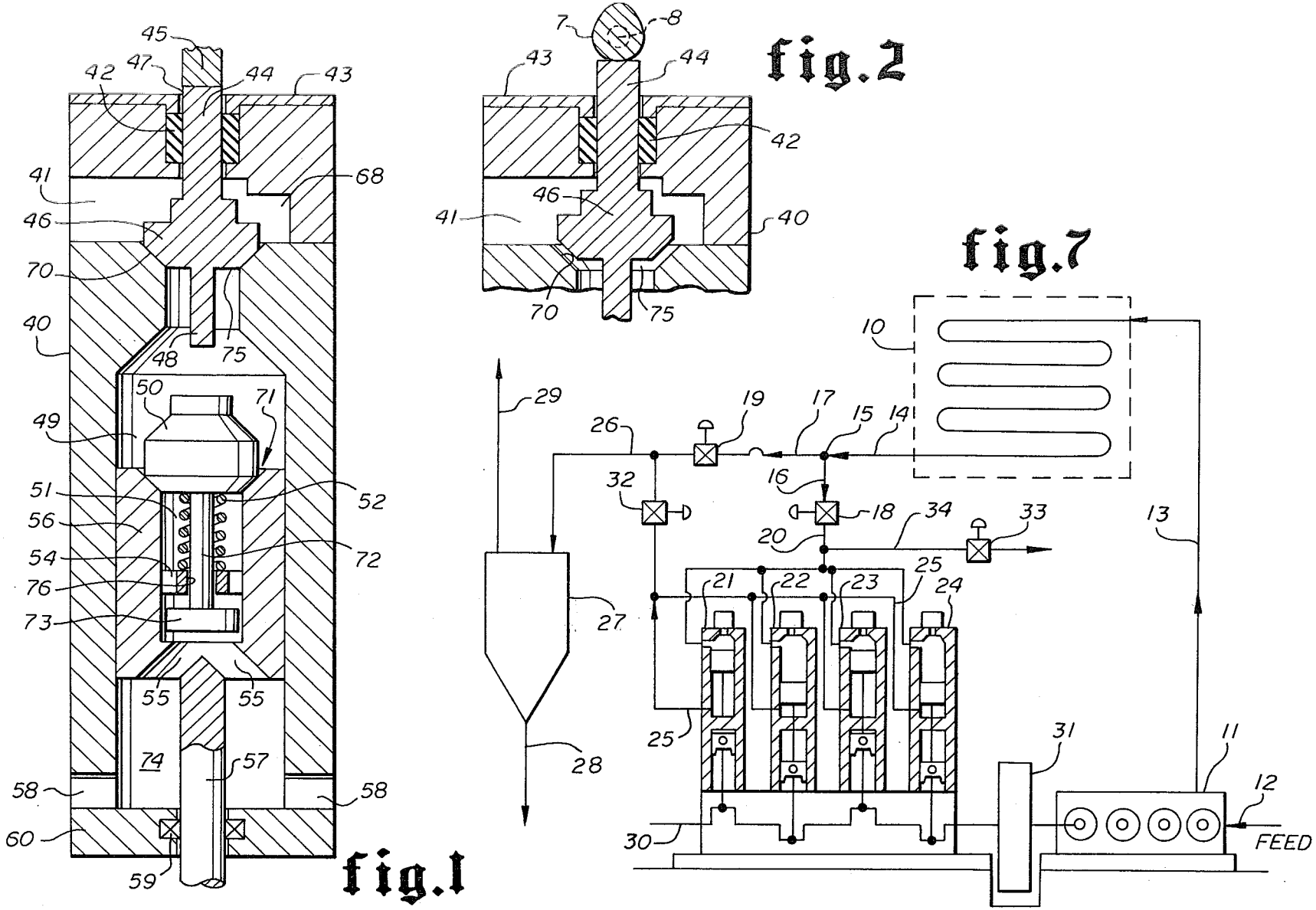
FIG. 1 is a cross sectional elevation of one cylinder of the reciprocating engine.
FIG. 2 is a partial cross sectional elevation showing an alternate actuating device from that of FIG. 1.
FIG. 7 is a schematic representation of a process energy recovery system and a schematic representation of an engine comprising four cylinders according to the present invention.

FIG. 1 is an enlarged detail of one cylinder of the reciprocating engine, the entry of effluent gas, for example, through line 20 of FIG. 7 is accomplished via inlet 41. Located in the inlet 41, is valve 46 which is seated against an annular frusto conical or beveled surface 70 thereby sealing the inlet from the expansion chamber 49. The inlet valve 46 is biased in place, thereby closing the inlet port 75, by a time adjustable inlet valve closing means 45 which in this embodiment is a plunger actuated for example, hydraulically or mechanically and which is adjustable to change the time of actuation. Actuation causes the plunger or cam follower to move against the stem 44 closing the inlet. The stem 44 is attached to the valve 46 in the engine block 40 via conduit 41. A high pressure valve stem packing 42 is held in place by packing gland flange 43. The chamber 68 adjacent to the inlet port 75 is always in contact with the effluent stream from the reactor.

In this embodiment the inlet valve closing means is located externally, and for ease of maintenance and simplicity of construction this is a preferred embodiment. However, a cam or hydraulic plunger could just as well be located within the chamber 68 above the inlet valve 46, with of course, some specific provision for guiding the valve 46, since stem 44 serves that purpose in this embodiment. In addition, an actuating means can be located within the cylinder itself.

Extending downward into the expansion chamber 49 from inlet valve 46 is a rod 48 which is adapted to contact a portion of piston valve 50. The operation and relationship of these two valves will be described in detail in regard to FIGS. 3–6. The piston valve 50 is normally biased by helical compression spring 52 out of conduit 51 which passes through piston 56, however FIG. 2 corresponds to the operational configuration shown in FIG. 4 and in such configuration, the piston valve 50 is seated into the opening 71, closing conduit 51, which indicates there is a pressure within the expansion chamber 49 greater than that in the exhaust chamber 74. The compressed spring 52 biases against the ring 54, which is fixedly mounted in conduit 51, and the lower surface of valve 50 tending to force the valve 50 out of conduit 51. Ports are provided in ring 54 so that the conduit 51 is continuous through the piston 56 and exits 55. The valve 50 is connected to rod 72 which extends through ring 54 and terminates in a head 73 which is larger than the opening 76 through ring 54, serving to restrain the extent of displacement of valve 50 out of opening 71 by spring 52. The piston 56 is connected to a rod 57 which extends through the bottom member 60 out of the cylinder through high pressure seal 59. Outlet ports 58 are provided from exhaust chamber 74, which for example, would then connect to line 25 as shown in FIG. 7.

FIG. 2 shows another means of actuating the closure of the inlet port 75 by valve 46. A cam 7 mounted eccentrically on shaft 8 is adjusted to rotate at a rate, to force the valve 46 into inlet port 75, which rate allows the optimum amount of reactor effluent into the expansion chamber 49.

Figure 3:
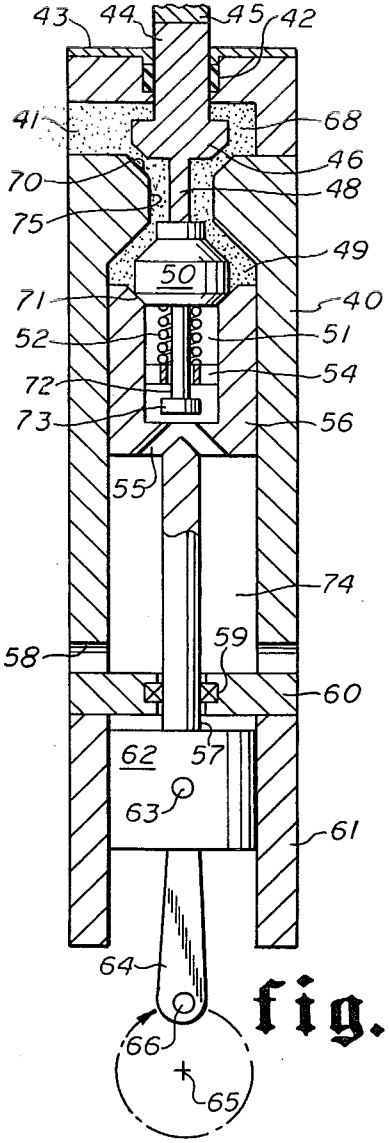

In FIGS. 3–6, a single cylinder is taken through the cycle of operation which will aid in understanding the operation of the apparatus and the relationship of the components of the engine. In FIG. 3, the piston 56 is at the top of its stroke in the cylinder. The piston valve 50 has contacted rod 48, forcing piston valve 50 to seat on the opening 71 of conduit 51 in the piston 56. The inlet valve is held closed because the pressure in the inlet port is approximately equal to the reactor outlet pressure, in the range of 1800–2800 bar, for example. As the piston 56 continues to travel upward, the contact between piston valve 50 and rod 48 which closed the piston valve 50 raises the inlet valve 46 off the beveled surface 70, thereby fluidly connecting expansion chamber 49 with the inlet 41 through port 75, allowing reactor effluent to enter the expansion chamber 49. At this time, the inlet valve closure means 45 is not actuated and stem 44 is free to rise.

As the piston continues to move, the inlet valve is lifted off its seat, pressurizing the expansion chamber to reactor pressure. With the expansion chamber now at reactor pressure, the inlet valve remains open because of the difference in cross-sectional areas due to the presence of the valve stem.

The effluent expands into expansion chamber 49, driving the piston 56 down. The pressure in expansion chamber 49 holds piston valve 50 closed. As the piston 56 travels down, inlet valve 46 is forced by the inlet valve closure means 45 against the beveled surface 70, isolating the expansion chamber 49 from chamber 68. The piston moves downward for $\frac{1}{2}$ to $\frac{3}{4}$ of its total stroke, at which point the inlet valve is pushed closed by the synchronized valve actuating device 45 which may be a hydraulic cylinder, or a mechanical cam or other suitable device. The exact timing of inlet valve closure may be varied to achieve the correct outlet pressure at the end of the expansion stroke for a wide range of inlet pressures and temperatures.

After the inlet valve is closed, the fluid in the cylinder will begin to expand. When the pressure has been reduced enough so that the pressure difference between the inlet port and the expansion chamber is sufficient to insure that the inlet valve remains closed, the actuating device 45 retracts or deactuates. As the effluent continues to expand, the pressure difference between chambers 68 and 49 will increase, holding inlet valve 46 closed even though the means 45 is deactuated. Piston valve 50 must be seated in conduit 51 before inlet valve 46 is forced open, thereby making full use of the expanding reactor effluent. This sequence may be obtained by the selection of spring 52 of appropriate resilience.

Figure 4:
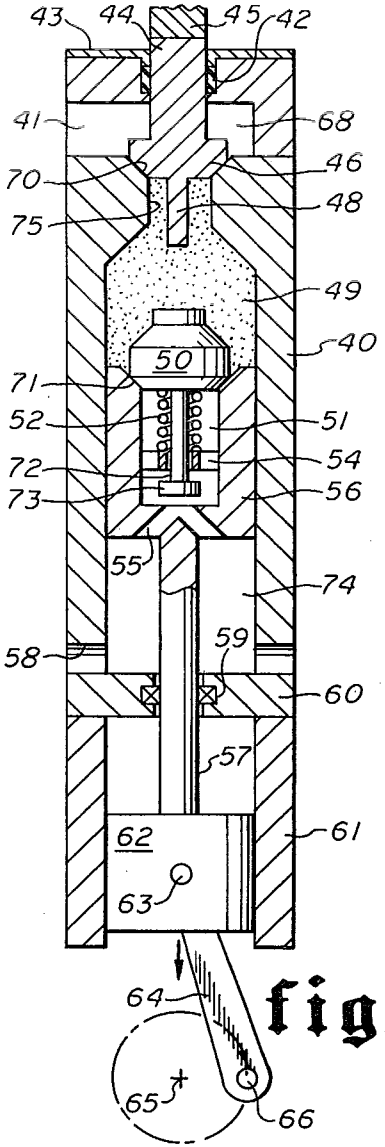

In FIG. 4, the piston 56 is shown at the middle point of its downward stroke, driving the rod 57 downward. Rod 57 is attached to crosshead 62 which rides within the guide 61. The crosshead is attached pivotally at 63 to an arm 64 which is in turn pivotally attached in the conventional manner to a crankshaft.

Figure 5:
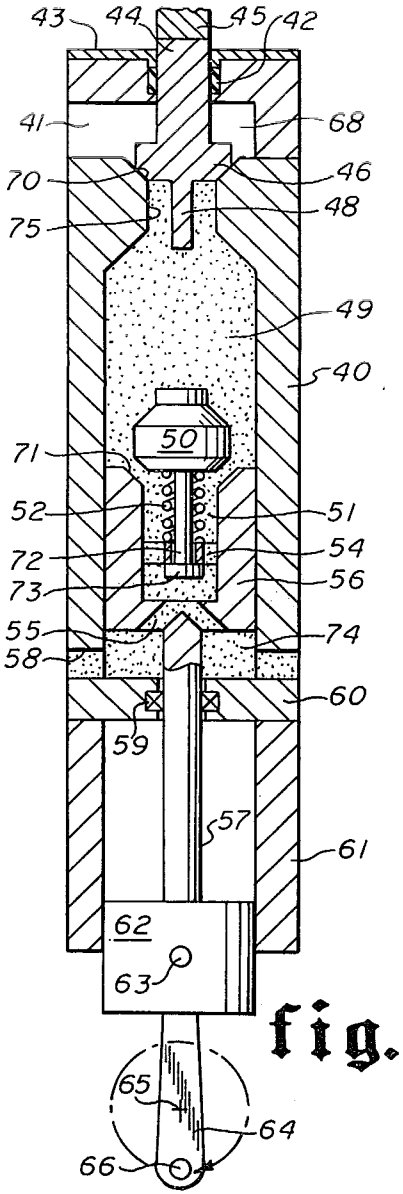

In FIG. 5, the piston 56 has reached the bottom of its stroke. The piston valve 50 opened during the downward stroke when the pressure within the expansion chamber 49 became approximately equal with the pressure in the exhaust chamber 74 thereby allowing the effluent to escape through the exhaust chamber 74 and outlet ports 58. The upward movement of the piston valve out of opening 71 is limited by head 73 attached to rod 72.

The present invention by its adjustable timing of reactor effluent into the expansion chamber 49 has restricted the opening of the piston valve 50 prematurely, by providing that the pressure within the expansion chamber 49 becomes approximately equal to the pressure in the exhaust chamber 74 shortly before the piston 56 reaches the bottom of its stroke. Similarly, the present invention has closed inlet valve 46 before too much reactor effluent has entered the expansion chamber, which could inhibit proper operation of the piston valve 50 or which would merely pass through the system without having the energy therein recovered.

Figure 6:
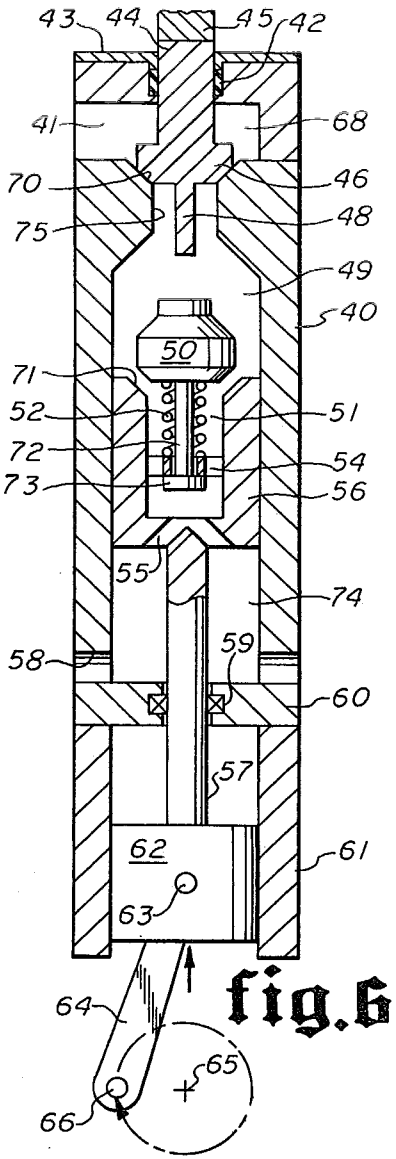
FIGS. 3–6 are a sequential illustration in cross section of the operation of one cylinder of the present reciprocating energy recovery engine through a full cycle.

In FIG. 6 the piston 56 is shown at a point halfway on its upward stroke. As the piston moves upward, the piston valve 50 is maintained by spring 52 out of the opening 71 such that the chamber 49 is fluidly connected through the piston via conduit 51 into the exhaust chamber 74 and the outlet ports 58 thereby forcing the gases which remain in the expansion chamber 49 out of the cylinder. As the piston 56 approaches top dead center, the inlet valve 46 is in the closed position, the piston valve 50 is in the opened position, and the pressure in the expansion chamber is slightly higher than the engine outlet pressure, in the range of 300–500 bar, for example.

The cycle will be repeated as the piston rises to the top of its stroke as shown in FIG. 3, hereby having caused one complete rotation of the crankshaft about its axis 65.

FIG. 7 shows the present invention employed in a process of recovery of energy in a high pressure low density polyethylene manufacturing and recovery facility. An ethylene feed 12 enters compressor 11 where it is pressurized and then passed into tubular reactor 10 via line 13. The effluent leaving reactor 10 via line 14 generally has a pressure in the range of 2000 to 3000 $kg/cm^2$. An autoclave reactor could, of course, be used in place of the tubular reactor, in which case the pressure of the reactor effluent would generally be in the range of 1500 to 2500 bar.

Under prior procedures, the effluent from reactor 10 would have proceeded through valve 19, where its pressure would be reduced to about 300 $kg/cm^2$ directly into high pressure separator 27. However, according to the present invention line 14 contains a tee 15 by which means 11 or a portion (usually a portion) of the reactor effluent may be passed through line 16 and valve 18 into line 20 which is connected to a plurality (four) of cylinders (each comprising an expansion chamber and an exhaust chamber) 21, 22, 23 and 24 respectively, wherein the effluent from the reactor 10 is sequentially valved into each cylinder as described above for expansion to operate pistons in the cylinder ultimately driving a crankshaft. In this particular embodiment, the crankshaft is connected to a synchronous motor 31 and back into the compressor 11. Alternatively the crankshaft may be connected to a fly-wheel and to other equipment (not shown) such as an electric generator.

The expanded gases from the reactor leave the cylinders via lines 25, pass through valve 32, and are combined with the reaction effluent which has by-passed the reciprocating engine via lines 17 and passed through valve 19, into line 26 through which the effluent gases from the reactor from all sources are fed into the high pressure separator 27. Liquid polymer is removed via line 28 which carries the liquid polymer to the low pressure separator (not shown) for further separation and purification. The unreacted ethylene is taken off via 29, and may be recycled to the reaction via line 12.

Valves 18 and 32 may be closed and valve 33 opened to allow maintenance of the energy recovery engine. Valve 19 is positioned by an automatic controller to maintain a predetermined pressure in the reactor.

Generally the pressure present in the reactor effluent is that necessary to operate the reciprocating engine and produce a positive energy output. However, other considerations of the system, such as temperature or pressure requirements of recovery equipment downstream of the reciprocating engine, are to be considered in the desirability of the system and in the degree of energy recovery. These requirements of course, will vary for each effluent system and the degree of energy recovery in relation thereto may be determined by the routineer in the art.

The effluent from the reciprocating engine will, in those systems wherein useful products are produced, be subjected to further treatment generally of the type to obtain the recovery and/or separation of product, unreacted reagents, by-products and the like.

In some embodiments only a portion of the reactor effluent will be passed to the reciprocating engine for recovery of the process energy. In the case of high pressure, low density polyethylene some portion of the reactor effluent is by-passed to the recovery apparatus to maintain the reactor pressure. However, other means than the use of reactor effluent may be employed to obtain this control and in any event the present invention contemplates passing all or a portion of a reactor effluent through the reciprocating engine for recovery of the energy therefrom.

The invention claimed is:

1. A reciprocating engine comprising: at least one cylinder, an inlet port in said cylinder, located toward one end thereof, an outlet port in said cylinder, located distal to said inlet port, a first valve movably seated in said inlet port, means biasing said first valve into said inlet port, a piston slidably movable in said cylinder, drive rod means operably associated said piston to a crankshaft, said piston having a conduit therethrough and a second valve movably mounted in said conduit, toward said first valve and aligned to contact said first valve, said second valve being biased out of said conduit, whereby contact of said first valve and said second valve forces said second valve into said conduit and forces said first valve out of said inlet port, wherein the improvement comprises time adjustable means for biasing said first valve into said inlet port to close said inlet.

2. The reciprocating engine according to claim 1 wherein said first valve is rectilinearly movable.

3. The reciprocating engine according to claim 1 wherein said piston is disposed between said inlet and outlet ports in said cylinder.

4. The reciprocating engine according to claim 1 wherein said second valve is adapted to seat in said conduit thus temporarily blocking said conduit.

5. The reciprocating engine according to claim 1 wherein said drive rod means comprises a first drive rod connected to a crosshead, said crosshead being connected to a second drive rod to said crankshaft.

6. The reciprocating engine according to claim 1 wherein said first valve is biased by a mechanism actuated independently.

7. The reciprocating engine according to claim 1 wherein said first valve has a stem extending exteriorly from said cylinder, said stem being operably associated with said means for biasing, whereby actuation of said biasing means forces said first valve into said inlet port and sealing said inlet port.

8. The reciprocating engine according to claim 7 wherein said biasing means are hydraulically actuated plungers.

9. The reciprocating engine according to claim 7 wherein said biasing means is a cam.

10. The reciprocating engine according to claim 6 wherein said mechanism is synchronized with the operation of the engine thereby metering effluent reactor materials into said cylinder in a manner to maximize the recovery of energy therefrom.

11. The reciprocating engine according to claim 1 having at least two cylinders.

* * * * *